US007331337B2

(12) United States Patent
Cuisinier

(10) Patent No.: US 7,331,337 B2
(45) Date of Patent: Feb. 19, 2008

(54) TOY WATER BALLOON LAUNCHER

(76) Inventor: Jarret Peter Cuisinier, 150 Almendral Ave., Atherton, CA (US) 94027

( * ) Notice: Subject to any disclaimer, the term of this patent is extended or adjusted under 35 U.S.C. 154(b) by 29 days.

(21) Appl. No.: 11/031,779

(22) Filed: Jan. 6, 2005

(65) Prior Publication Data

US 2005/0188970 A1 Sep. 1, 2005

Related U.S. Application Data

(60) Provisional application No. 60/535,086, filed on Jan. 8, 2004.

(51) Int. Cl.
*F41B 3/00* (2006.01)

(52) U.S. Cl. ..... 124/5

(58) Field of Classification Search ..... 5/601, 5/482, 494, 497, 498; 124/4, 5
See application file for complete search history.

(56) References Cited

U.S. PATENT DOCUMENTS 922,432 A * 5/1909 Jirotka ..... 473/514
1,075,041 A * 10/1913 Kirkness ..... 124/5
1,607,874 A * 11/1926 Darton ..... 124/5
3,901,208 A * 8/1975 Laporte et al. ..... 124/5
4,677,961 A * 7/1987 Allison ..... 124/5
4,922,884 A 5/1990 Ford
5,088,469 A * 2/1992 Hargrave ..... 124/5
5,427,084 A 6/1995 Arnold et al.
5,515,835 A * 5/1996 Minneman et al. ..... 124/5
5,624,295 A * 4/1997 Watkins ..... 446/475
6,076,829 A 6/2000 Oblack

* cited by examiner

*Primary Examiner*—John A. Ricci

(57) ABSTRACT

The present invention provides a simple, safe, and reliable toy water balloon launcher configuration for launching water balloons. For example, a toy water balloon launcher comprises a shaft and a slit designed to receive water balloons. A user then swings the entire water balloon launcher. The resulting force pulls the water balloon from the slit and toward a target.

26 Claims, 8 Drawing Sheets

TOY WATER BALLOON LAUNCHER

CROSS-REFERENCE TO RELATED APPLICATIONS

This application claims priority to U.S. Provisional Patent Application Ser. No. 60/535,086 entitled "Toy Water Balloon Launcher" and filed on Jan. 8, 2004 which is incorporated herein by reference.

FIELD OF INVENTION

This invention relates to children entertainment devices, and more particularly, to children entertainment devices such as toy water balloon launchers.

BACKGROUND OF THE INVENTION

A variety of water balloon launching devices have been described in the prior art. These devices have configurations ranging from slings to slingshots, and from lacrosse rackets to jai-alai cestas. All of these devices are effective at hurling a water balloon farther than human factors would naturally permit. However, all of these configurations have a significant and innate drawback when used as a toy—safety.

In addition to safety, another drawback of many toy water balloon launchers is that they are only able to launch one water balloon at a time. In many instances, it is preferable to launch multiple water balloons simultaneously in order to increase the target area coverage or in order to increase the likelihood of striking a small target.

Accordingly, a toy water balloon launcher that has increased safety is desirable. In addition, a toy water balloon launcher that is specialized to specifically and exclusively launch water balloons is as well desirable. Additionally, a toy water balloon launcher that is able to launch multiple water balloons simultaneously is also desirable.

SUMMARY OF THE INVENTION

The present invention provides a safer toy configuration for launching water balloons. In accordance with an exemplary embodiment of the present invention, a toy water balloon launcher comprising a shaft and a slit is designed to receive a water balloon along the slit. A user then swings the entire water balloon launcher. The resulting force pulls the water balloon from the slit and toward a target.

BRIEF DESCRIPTION OF THE DRAWINGS

Additional aspects of the present invention will become evident upon reviewing the non-limiting embodiments described in the specification taken in conjunction with the accompanying figures, wherein like numerals designate like elements, and.

DETAILED DESCRIPTION

The following descriptions are of preferred exemplary embodiments only, and are not intended to limit the scope, applicability, or configuration of the invention in any way. Rather the following description provides a convenient illustration for implementing a preferred embodiment of the invention. Various changes may be made in the function and arrangement of elements described in the preferred embodiments without departing from the spirit and scope of the invention as set forth herein.

Generally, in accordance with a preferred embodiment of the present invention, a toy water balloon launcher is provided for safely launching water balloons. More particularly, in various embodiments a toy water balloon launcher may be specialized to receive water balloons. For example, a toy water balloon launcher comprising a shaft and a receiver. In accordance with an embodiment of the present invention, the receiver is configured as slit that is designed to receive a water balloon. A user then swings the entire water balloon launcher in a circular path. The resulting force pulls the water balloon from the slit and toward a target. Of course, it should be appreciated that any number of movements that create a pulling force on the balloon can be used while still falling within the scope of the present invention.

However, in accordance with alternate embodiments of the present invention the receiver may comprise alternate configurations designed to receive water balloons. For example, in accordance with an alternate embodiment of the present invention the receiver may be configured as a clamp. However, in accordance with another alternate embodiment of the present invention the receiver may be configured as a cup.

Additionally, in accordance with one aspect of the present invention, the water balloon launcher may be suitably configured to be integrated with a water balloon filling system or a water gun. For example, a centrifugal force water gun may be integrated with the water balloon launcher to allow a user to release a blast of water via the same swinging motion.

Figure 1A:
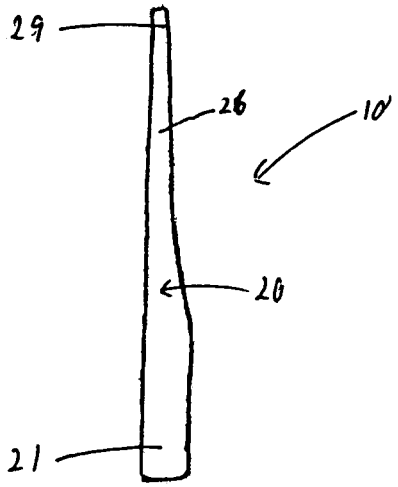
FIG. 1*a* is an exterior side view of an exemplary embodiment of the water balloon launcher.
Figure 1B:
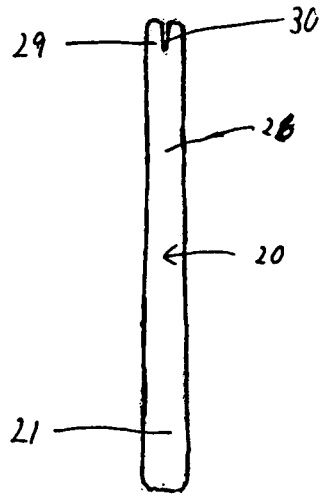
FIG. 1*b* is an exterior front view of an exemplary embodiment of the water balloon launcher.
Figure 1C:
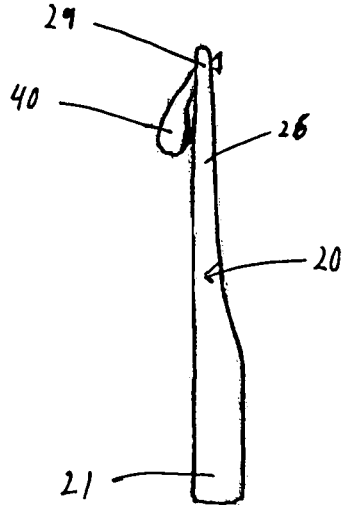
FIG. 1*c* is an exterior side view of an exemplary embodiment of the water balloon launcher loaded with a water balloon.

Thus, with reference to FIG. 1*a*, FIG. 1*b*, and FIG. 1*c*, in accordance with an exemplary embodiment of the present invention, a toy water balloon launcher 10 is shown comprising a shaft 20 and a slit 30. A filled water balloon 40 is shown loaded on launcher 10 in FIG. 1*c*. Shaft 20 further comprises a first end 21 and a second end 29 and slit 30 is preferably located proximate second end 29. However, in accordance with various alternate embodiments, the position, size, shape, and number of shaft 20, slit 30, first end 21, and second end 29 may as well vary.

In accordance with the present exemplary embodiment, shaft 20 is preferably composed of a material that is lightweight and suitably flexible, such as a polymer. However, in accordance with various alternate embodiments shaft 20 may be substituted with heavy or inflexible materials and may as well be substituted with alternative materials including composites, metals, woods, and the like. Moreover, shaft 20 preferably further comprises a stem 26 below slit 30, stem 26 being preferably narrower so as to be slightly pliable, though still rigid. Thus, stem 26 can flex while launching water balloons, helping to fling the balloons greater distances.

However, in accordance with various alternate embodiments of the present invention, shaft 20 and comprised stem 26 may have uniform or expanding dimensions along its length. Furthermore, shaft 20 and stem 26 are preferably composed of a material that is adequately resilient and has ample shape memory so that shaft 20 will return to its original, unflexed form after launching balloon 40 and so that launcher 10 can be used repeatedly.

With continuing reference to FIGS. 1(*a-c*), shaft 20 is preferably of adequate length so that a water balloon may be launched large distances during use. Of course, depending on the particular application and in accordance with various alternate embodiments of the invention, shaft 20 may be shortened significantly. In such cases, water balloon launcher 10 preferably comprises an elongated slit 30, thereby allowing shorter launcher 10 to receive and launch, though not as far, multiple water balloons 40 simultaneously.

Figure 2A:
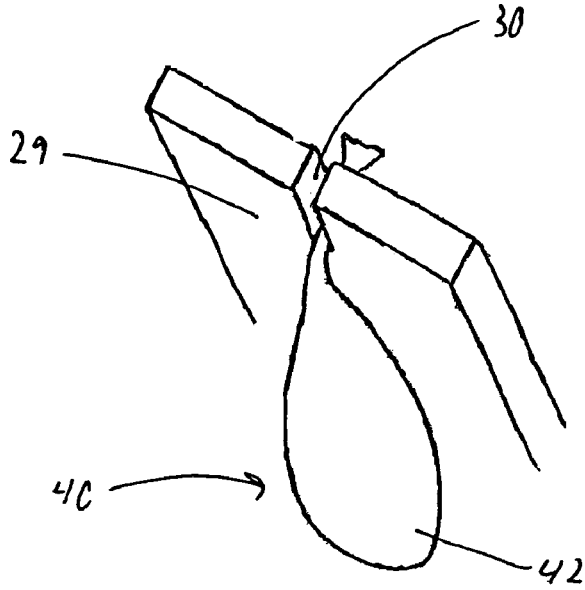
FIG. 2*a* is a perspective view of the slit of an exemplary embodiment illustrating how the slit holds a water balloon.
Figure 2B:
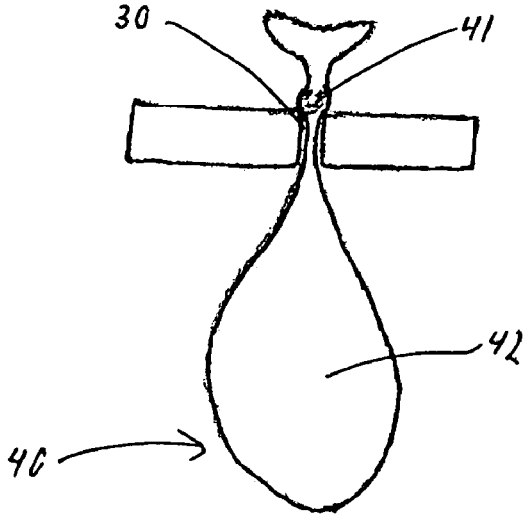
FIG. 2*b* is a crosscut view of the slit of an exemplary embodiment illustrating how the slit holds a water balloon.

Now, with reference to FIG. 2*a* and FIG. 2*b* and in accordance with the present exemplary embodiment, slit 30 preferably has a width of about one millimeter, thereby enabling slit 30 to hold standard water balloon 40 below a knot 41 and above a water balloon volume 42. However, in accordance with various alternate embodiments of the present invention, slit 30 may receive balloon 40 above knot 41 and below an orifice of balloon 40. Regardless, a slender width of slit 30 is additionally preferable as it suitably prevents non-balloon items from being received by slit 30.

However, in accordance with other various alternate embodiments of the invention, slit 30 may have different dimensions depending on the type of balloon desired to be received and launched. Moreover, slit 30 may be configured to launch specially designed balloons. For example, slit 30 may receive balloon 40 along a special groove proximate a neck of balloon 40.

Additionally, slit 30 preferably has a depth of about one centimeter, though in accordance with various alternate embodiments of the present invention, slit 30 may have longer and shorter lengths.

In accordance with another aspect of the present invention, proximate a bottom of slit 30, second end 29 preferably has a material thickness of about three millimeters, which may aid in distributing the pressure placed on water balloon 40 during the throwing motion. Again, in accordance with various alternate embodiments of the present invention, second end 29 may have various thicker and thinner dimensions. Preferably, slit 30 comprises dull edges so as to prevent laceration of balloon 40. In addition, preferably all of toy launcher 10 (especially second end 29 of shaft 20) has dull corners and edges. Moreover, second end 29 preferably further comprises a wide leading edge.

Figure 3A:
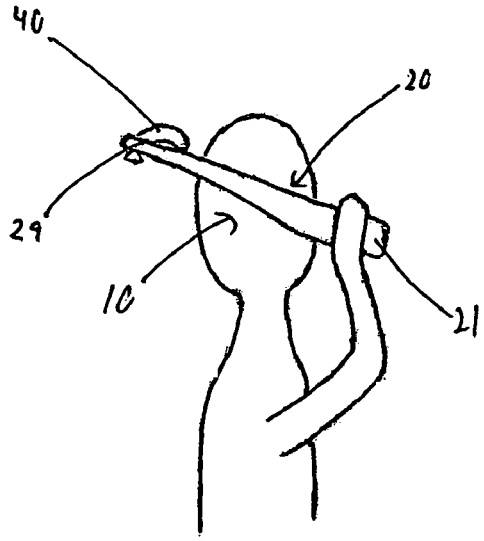
FIG. 3*a* is an exterior side view of an exemplary embodiment illustrating how a user would preferably hold and "cock" the device.
Figure 3B:
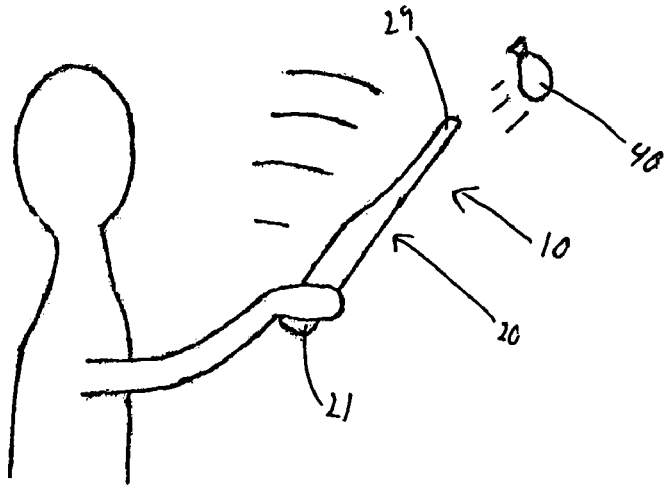
FIG. 3*b* is an exterior side view of an exemplary embodiment illustrating how a user would preferably "launch" a water balloon from the device.

Thus, in accordance with the present exemplary embodiment of the invention and now in reference to FIG. 3*a* and FIG. 3*b*, a user can launch water balloon 40 from toy water balloon launcher 10 through a motion. In use, with respect to the present exemplary embodiment, a user can insert water balloon 40 into slit 30. Once loaded, launcher 10 is grasped near first end 21. Launcher 10 is then preferably moved forward along a circular path causing water balloon 40 to be released from slit 30 towards a target.

Figure 4A:
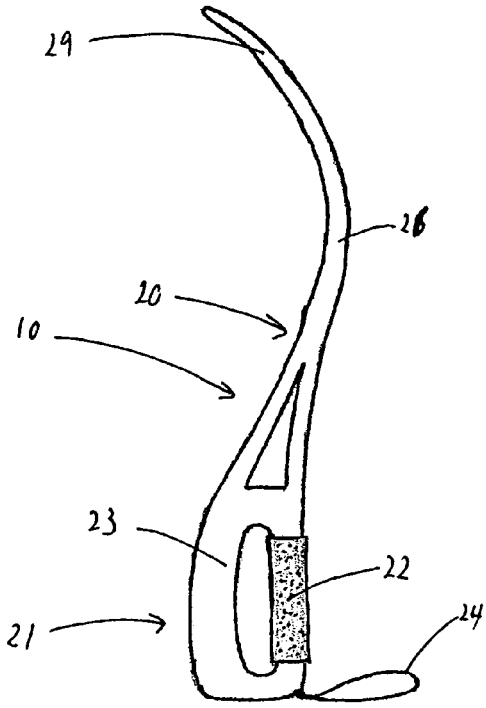
FIG. 4*a* is an exterior side view of a preferred embodiment incorporating various supplementary features.
Figure 4B:
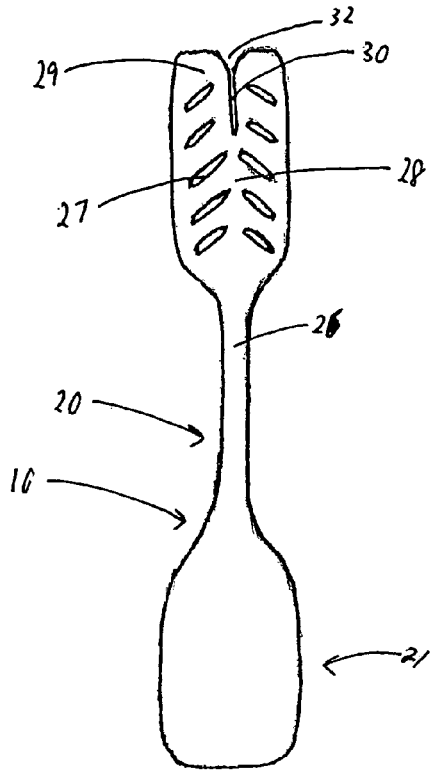
FIG. 4*b* is an exterior front view of a preferred embodiment incorporating various supplementary features.
Figure 4C:
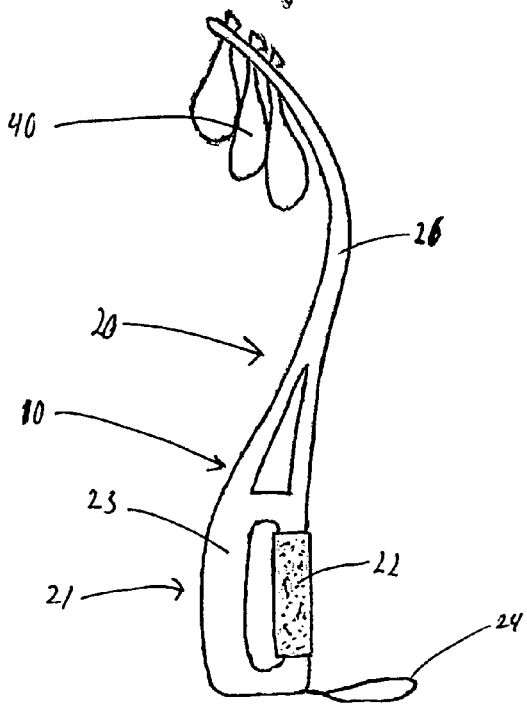
FIG. 4*c* is an exterior side view of a preferred embodiment incorporating various supplementary features and loaded with multiple water balloons.

Now with reference to FIG. 4*a*, FIG. 4*b*, and FIG. 4*c*, a preferred embodiment of the invention is shown and various additional optional aspects are described below. These embodiments incorporate various supplementary features intended to optimize the overall use of the invention for the user. However, as above, various alternate embodiments of the present invention may omit some or all of these features, utilize another combination of these features, or utilize these and additional features not here described.

In accordance with one aspect of a preferred embodiment of the invention, shaft 20 proximate first end 21 further comprises a handle 22, a handle guard 23, and a strap 24. In addition, shaft 20 is configured to (e.g. by a forward arc configuration) center and balance water balloon 40 over handle 22 during times of rest and further aid in the angle of departure of water balloon 40 from slit 30 during a launching motion. Preferably, second end 29 has a launching angle of about 45 degrees, though, in accordance with alternate embodiments of the invention, second end 29 may have various alternate launching angles or even an adjustable shaft 20 for allowing adjustment of the launching angle. For example, shaft 20 may comprise a pivot, making various launching angles possible.

In accordance with alternate embodiments of the invention, shaft 20 may have other configurations known or not yet know to the prior art. For example, shaft 20 may have a backwardly angled or curved configuration. Such a configuration may be used to increase the flex of shaft 20 during a throwing motion and may be used to delay the release of balloon 40 until later in the throwing motion. Furthermore, in accordance with another such alternate embodiment of the present invention, shaft 20 may comprise multiple shafts having various configurations. For example, shaft 20 may comprise two shafts members supporting second end 29. Preferably, in such an embodiment, two shafts 20 would be unaligned along a throwing circumference. For example, second end 29 may comprise a rectangular piece with slit 30 proximate a small side of the rectangular piece. Thus, unaligned shafts 20 may connect to second end 29 at opposing long sides of the rectangular piece and shafts 20 may be further located at opposite ends of their long sides so as to be unaligned along the throwing circumference. In accordance with a preferred embodiment, the length of shaft 20 is preferably increased. However, in accordance with various alternate embodiments of the invention, shaft 20 may be elongated further. In such cases, handle 22 may be adapted to receive both hands of the user for increased leverage. Furthermore, in accordance with various embodiments shaft 20 utilizes I-beam construction to increase the strength-to-mass ratio of shaft 20.

Figure 5:
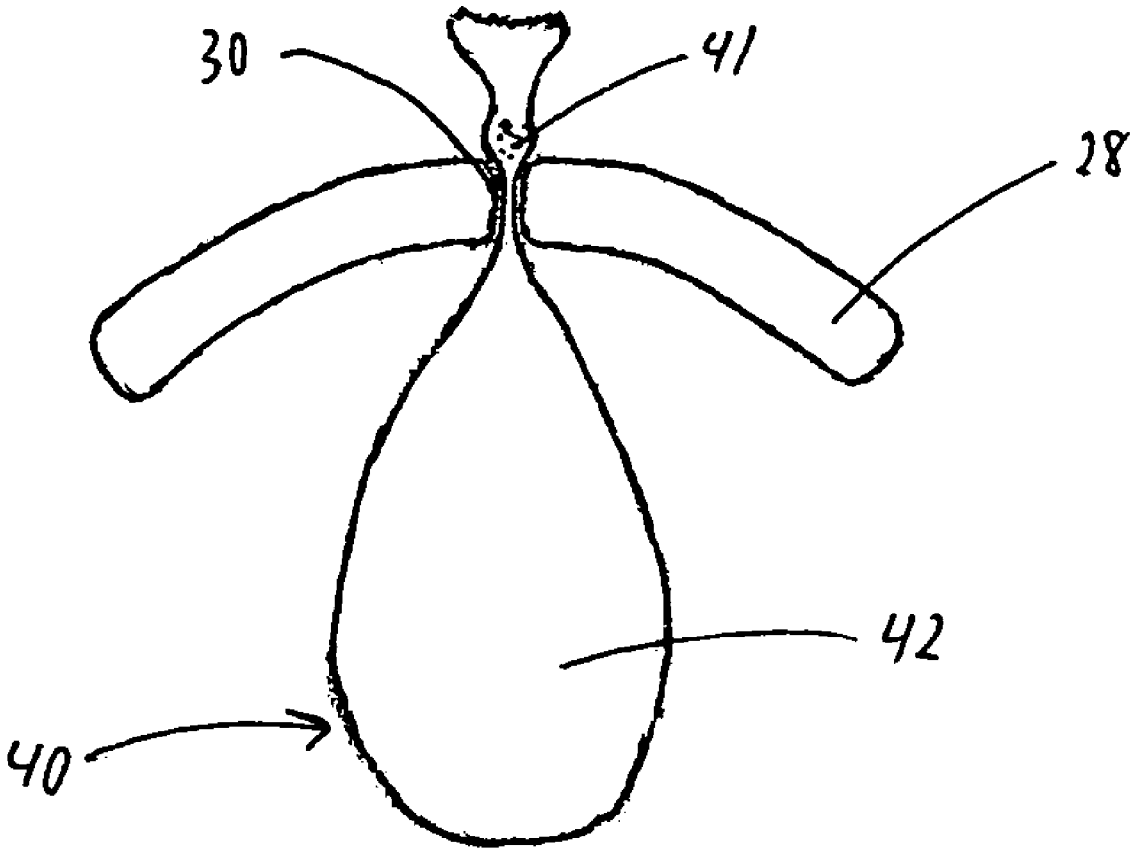
FIG. 5 is a crosscut view of the slit and fan of a preferred embodiment illustrating how the slit holds a water balloon.

In accordance with another aspect of a preferred embodiment and with reference to FIG. 5, shaft 20 proximate second end 29 comprises a fan 28. Fan 28 is preferably cupped to contain balloon 40 during a launching motion. Additionally, in accordance with various alternate embodiments of the present invention, fan 28 may further comprise a parabolic shape along a plane parallel to slit 30. This shape may help to further support balloon 40 during a throwing motion. Additionally, fan 28 may further comprise grooves, steps, ridges, or texture to help further support balloon 40 during a throwing motion. That said, various alternate configurations of fan 28 not here described may further be used and fall within the scope of the present invention.

In accordance with one aspect of the present invention, slit 30 comprises a mouth 32. Mouth 32 is preferably wider than slit 30 so as to make easier the reception of water balloon 40. Moreover, mouth 32 preferably meets slit 30 at an angle 32 so as to prevent the wedging of items within slit 30. However, and in accordance with various alternate embodiments of the present invention, mouth 32 may smoothly contract into narrower slit 30. Additionally, slit 30 may also contract to a point (i.e. a width of zero). In addition, mouth 32 may be one-sided. For example, only one side of slit 30 may expand to form mouth 32.

Furthermore, and referencing to FIGS. 4(*a-c*) and FIG. 5, slit 30 is elongated so as to enable slit 30 to receive multiple balloons 40 and to thereby allow launcher 10 to launch multiple balloons 40 at the same time. Accordingly, the width of fan 28 is preferably designed to match the expected balloon payload size and layout. Therefore, in accordance with alternate embodiments of the invention, the size and shape of fan 28 may vary. In addition, fan 28 comprises a gap 27 to reduce the overall drag of fan 28 during a launching motion. In accordance with various alternate embodiments, slit 30 may further comprise a bridge to reduce the flex of the opposing sides of slit 30 and fan 28. Moreover, and in accordance with various alternate embodiments, slit 30 may comprise a clamp to lock balloon 40 in slit 30 or to permit only one or a set of multiple balloons 40 from exiting slit 30 during a launching motion.

In accordance with a preferred embodiment, shaft 20, handle 22, handle guard 23, and fan 28 are integrated into one consolidated piece, all composed of the same material. However, in accordance with alternate embodiments, shaft 20, handle 22, handle guard 23, and fan 28 may be separate parts and composed of different materials.

Figure 6:
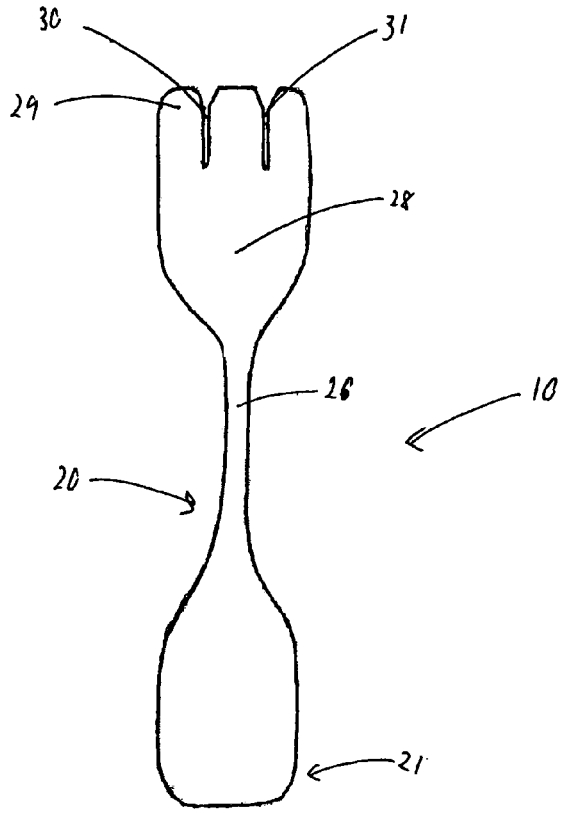
FIG. 6 is an exterior front view of an embodiment comprising multiple slits.

Referring now to FIG. 6, in accordance with another alternative embodiment of the present invention, a multi-slit embodiment is shown. A second slit 31 is presented possessing a similar configuration as slit 30. Furthermore, fan 28 is suitably widened in order to accommodate the increased balloon payload.

Figure 7:
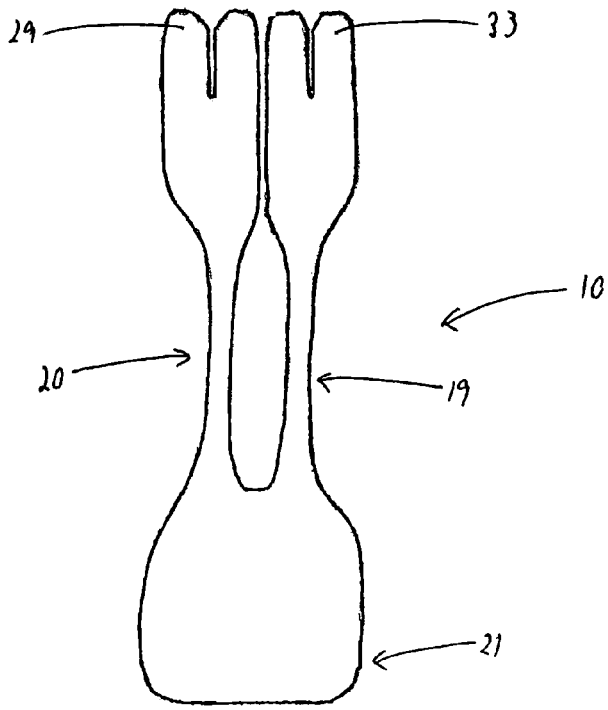
FIG. 7 is an exterior front view of an embodiment comprising multiple slit ends.

Referring now to FIG. 7, in accordance with another alternative embodiment of the present invention, a multi-end embodiment is shown. An additional second end 33 is presented possessing a similar configuration and comprising similar components as second end 29. Furthermore, launcher 10 further comprises an additional shaft 19 with similar configuration as shaft 20. Second end 29, additional second end 33, shaft 20, additional shaft 19, and handle 21 are integrated into one consolidated piece, all composed of the same material. However, in accordance with alternate embodiments, second end 29, additional second end 33, shaft 20, additional shaft 19, and handle 21 may be separate parts and composed of different materials.

Furthermore, and again in accordance with alternate embodiments of the present invention, additional second end 33 and additional shaft 19 along with a second handle form a second launcher 11. Second launcher 11 may connect via a connector to launcher 10 and form a separable embodiment similar to the integrated, multi-ended embodiment disclosed in FIG. 7. Moreover, launcher 10 and second launcher 11 may also be separated, providing the user with multiple launchers. The connector may be configured to be one of a variety of connecting means already known to the prior art or one of those not yet known. For example, the connector may be a sliding male/female locking mechanism or a plurality of such mechanisms. In addition, second end 29 and additional second end 33 may as well be connectable via a connector.

Figure 8:
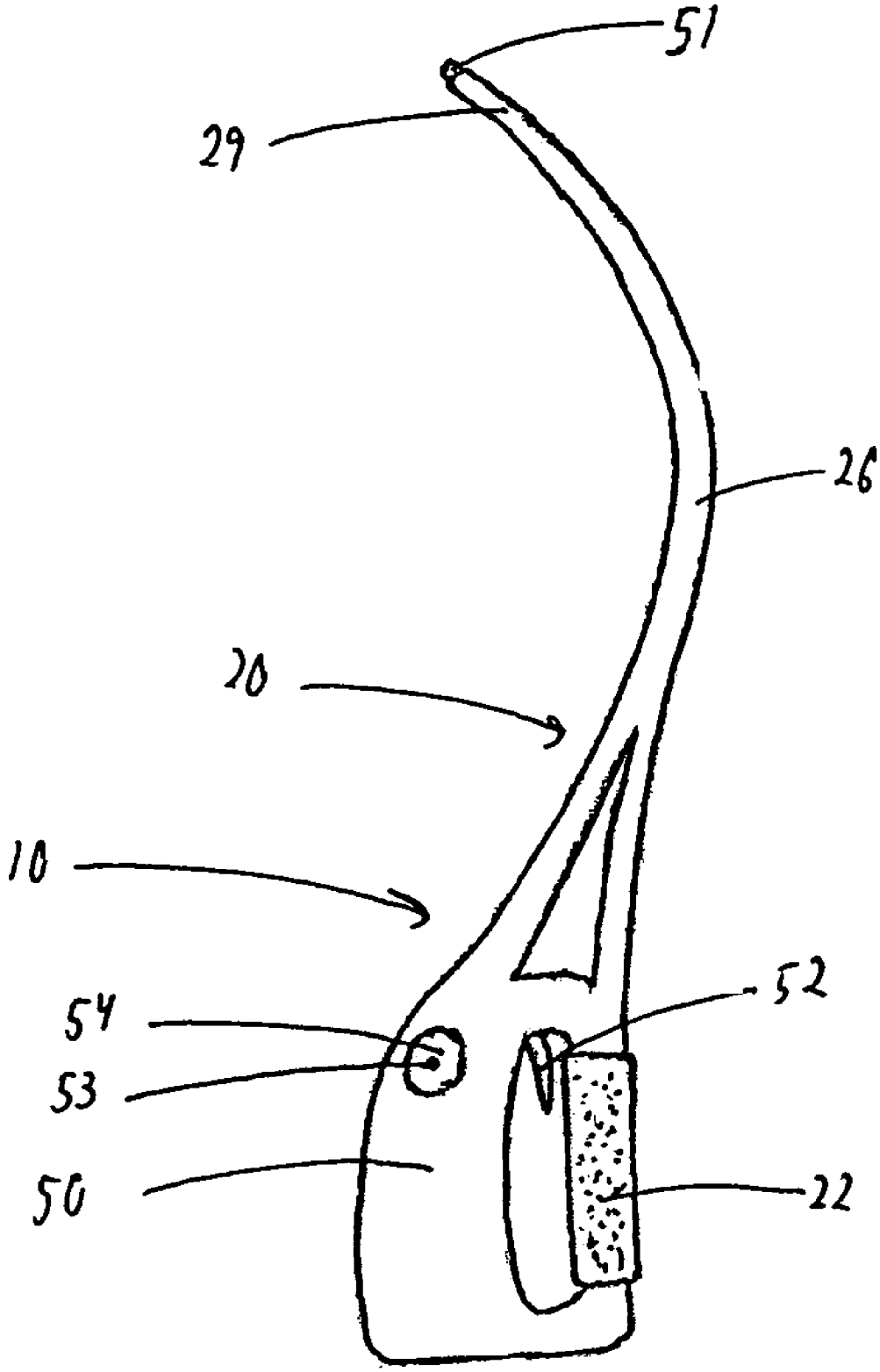
FIG. 8 is an exterior side view of an embodiment with an integrated water gun.

Now with reference to FIG. 8, another alternate embodiment of the invention is presented. In accordance with this embodiment of the invention, toy water balloon launcher 10 is integrated with a centrifugal force water gun. However, in accordance with various alternate embodiments of the invention, launcher 10 may be integrated with various other water gun types known to the prior art or not yet known. Furthermore, launcher 10 may be connected via a connector to various types of water guns rather than be fully integrated.

With continuing reference to FIG. 8, the centrifugal force water gun operates via the same launching motion utilized for launcher 10 and can, therefore, be used concurrently with launcher 10 or separately. The water gun uses the centrifugal force from the launching motion to pull water out of a reservoir 50 and towards a nozzle 51. Nozzle 51 may be located anywhere along shaft 20, but is preferably located proximate second end 29. In accordance with an alternate embodiment of the present invention, nozzle 51 releases water along the inner surface of fan 28 in order to also lubricate the surface for the release of water balloon 40. Additionally, a controller 52 is preferably included in order to better control the flow of water from reservoir 50 to nozzle 51. In addition, a one-way valve 53 normalizes the pressure vacuum in reservoir 50 resulting from the exit of water. Preferably, a fill cap 54 is present in order to facilitate a user in filling reservoir 50.

However, in accordance with various alternate embodiments of the invention, such an integrated centrifugal water gun configuration may instead be used in combination with other types of centrifugal force water balloon launchers. For example, a centrifugal water gun may be integrated with a water balloon launcher comparable to a jai alai cesta.

Figure 9A:
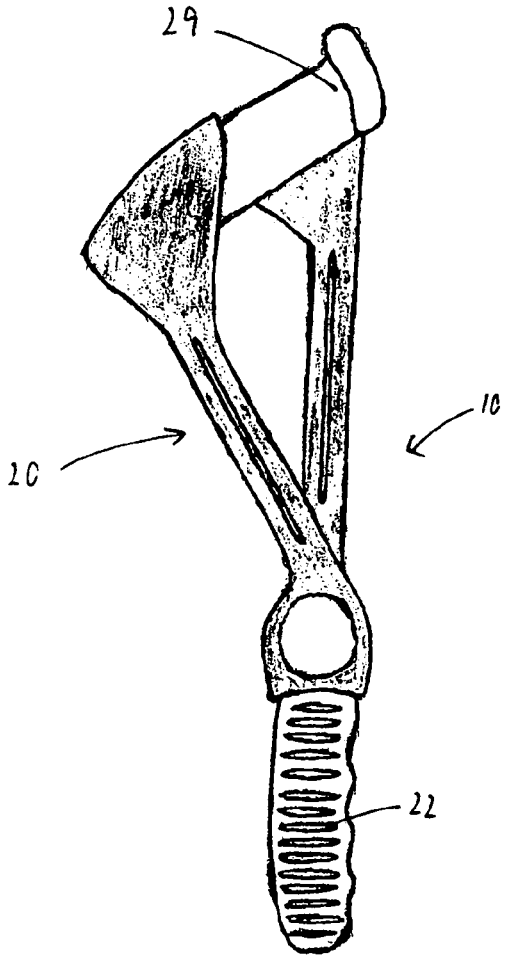
FIG. 9*a* is an exterior side view of an embodiment comprising two shaft members; and, FIG. 9*b* is an exterior front view of an embodiment comprising two shaft members.
Figure 9B:
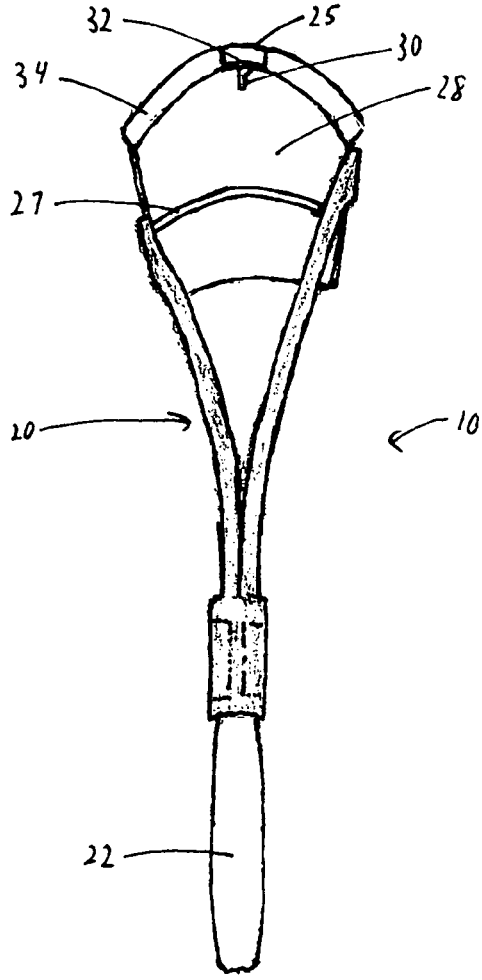

With reference now to FIGS. 9*a* and 9*b*, an alternate embodiment of the invention is presented. In accordance with one aspect of the present invention, fan 28 is parabolic-shaped from a side view (as shown in FIG. 9*a*) and cupping from a front view (as shown in FIG. 9*b*). Additionally, fan 28 further comprises a step 27 and second end 29 further comprises a wide leading edge 34 and a bridge 25. In accordance with another aspect of the present invention, shaft 20 comprises two unaligned shafts members supporting second end 29.

Still further, the present invention may incorporate various supplementary features intended to further optimize the overall use of the invention for the user. For example, toy water balloon launcher 10 may comprise a storage compartment for water balloons—filled, unfilled, or both. Additionally, launcher 10 may be fully or partially covered with an aesthetic housing.

Launcher 10 may further comprise a counterweight to facilitate the user in creating a swinging motion. For example, such a counterweight may be integrated with handle guard 23 or may be present as the filled balloon storage compartment. In accordance, with alternate embodiments of the present invention, the counterweight may be configured to be located at the tip of first end 21. In such embodiments, first end 21 may also be extended in order to increase the leverage of the counterweight.

Furthermore, fan 28 may completely cover water balloon 40 on all sides except the side at the tip of second end 29, thereby providing supplementary support for balloon 40 as it rests on slit 30.

In addition, shaft 20 may be adjustable in length so as to facilitate transport and storage as well as to increase and decrease the range of water balloon launcher 10. For example, two exemplary adjustable length configurations include a shaft 30 comprising folding segments as well as a shaft 30 comprising telescoping segments. In such embodiments, shaft 30 may extend during a throwing motion by centrifugal force via such telescoping segments.

Moreover, an angle formed by shaft 20 may be adjustable so as to allow a user to choose an angle of departure for balloon 40. Likewise, other parts of launcher 10 may also be moveable so as to make easier the overall use of launcher 10. For example, slit 30 may expand along a locking pivot joint so as to facilitate the reception of balloon 40. Moreover, via similar moving parts and via a contracting slit 30, slit 30 may be present in a clip configuration that grasps balloon 40 until its release during a launching motion. Additionally, launcher 10 may have remotely controllable moving parts. For example, the width of slit 30 may be expandable via a remote controller located elsewhere on launcher 10. Thereby, a user can expand slit 30 during a launching motion, facilitating the launch of balloon 40 from slit 30.

Finally, while the principles of the invention have been described in illustrative embodiments, many combinations and modifications of the above-described structures, arrangements, proportions, the elements, materials, and components, used in the practice of the invention in addition to those not specifically described may be varied and particularly adapted for a specific environment and operating requirement without departing from those principles.

I claim:

1. A toy water balloon launching device comprising a shaft, wherein the shaft further comprises:

a first end, a second end, and a slit proximate said second end of the shaft, wherein said slit receives a water balloon and wherein said shaft proximate said second end further comprises a fan and wherein said fan is cupping.

2. The launching device of claim 1, wherein said slit is configured to receive said water balloon on a neck of said water balloon.

3. The launching device of claim 1, wherein said slit releases said water balloon when said shaft is held near said first end and the water balloon launching device is swung in a circular path.

4. The launching device of claim 1, wherein said slit comprises a width of about one millimeter.

5. The launching device of claim 1, wherein said slit comprises a length of about one centimeter.

6. The launching device of claim 1, wherein said slit comprises an elongated length to receive multiple water balloons.

7. The launching device of claim 1, wherein said second end comprises a material width of about 3 mm at a bottom of said slit.

8. The launching device of claim 1, wherein said slit comprises a wide mouth at an end of said slit.

9. The launching device of claim 1, wherein said second end comprises one or more additional slits.

10. The launching device of claim 1, wherein said shaft comprises one or more additional second ends.

11. The launching device of claim 1, wherein said slit comprises a clamp.

12. The launching device of claim 1, wherein said shaft proximate said first end further comprises a handle.

13. The launching device of claim 1, wherein said second end comprises a forward slanting angle relative to a vertical axis of said first end.

14. The launching device of claim 13, wherein said forward slanting angle is about 45 degrees relative to said vertical axis of said first end.

15. The launching device of claim 13, wherein said angle is adjustable and wherein said shaft further comprises a pivot for creating said adjustable angle.

16. The launching device of claim 1, wherein said slit is positioned via said shaft substantially collinear with a vertical axis of said first end.

17. The launching device of claim 1, wherein said shaft comprises a plurality of shaft members.

18. A toy water balloon launching device comprising a shaft, wherein the shaft further comprises:

a first end, a second end, and a slit proximate said second end of the shaft, wherein said slit receives a water balloon and wherein said shaft proximate said second end further comprises a fan and wherein said fan is parabolic shaped.

19. A toy water balloon launching device comprising a shaft, wherein the shaft further comprises:

a first end, a second end, and a receiver proximate said second end of the shaft, wherein said receiver receives a water balloon and wherein said second end comprises an adjustable angle relative to a vertical axis of said first end and wherein said shaft further comprises a pivot for creating said adjustable angle.

20. The launching device of claim 19, wherein said launching device further comprises a counterweight.

21. A toy water balloon launching device comprising a shaft, wherein the shaft further comprises:

a first end, a second end, and a receiver proximate said second end of the shaft, wherein said receiver receives a water balloon and wherein said launching device comprises a connector and wherein said connector connects said launching device with a second launching device of a similar configuration and wherein when said launching devices are connected they form an integrated, double launching device.

22. The launching device of claim 21, wherein said receiver is a slit.

23. A toy water balloon launching device comprising a shaft, wherein the shaft further comprises:

a first end, a second end, and a receiver proximate said second end of the shaft, wherein said receiver receives a water balloon and wherein said launching device comprises a connector and wherein said connector connects said launching device with a water gun.

24. A toy water balloon launching device comprising a shaft, wherein the shaft further comprises:

a first end, a second end, and a receiver proximate said second end of the shaft, wherein said receiver receives a water balloon and wherein said launching device comprises an integrated water gun.

25. The launching device of claim 24, wherein said water gun comprises a water balloon-filling nozzle.

26. The launching device of claim 24, wherein said water gun utilizes a centrifugal force to create a water release.

* * * * *